US010801431B2

(12) United States Patent
Thomas et al.

(10) Patent No.: US 10,801,431 B2
(45) **Date of Patent: *Oct. 13, 2020**

(54) METHOD AND SYSTEM FOR CYLINDER IMBALANCE ESTIMATION

(71) Applicant: Ford Global Technologies, LLC, Dearborn, MI (US)

(72) Inventors: Joseph Lyle Thomas, Holt, MI (US); Ethan D. Sanborn, Saline, MI (US); Paul Hollar, Belleville, MI (US); Daniel Dusa, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/271,491

(22) Filed: Feb. 8, 2019

(65) Prior Publication Data

US 2019/0170073 A1 Jun. 6, 2019

Related U.S. Application Data

(63) Continuation of application No. 15/727,337, filed on Oct. 6, 2017, now Pat. No. 10,208,686.

(51) Int. Cl.
*F02D 41/14* (2006.01)
*F02D 41/24* (2006.01)
(Continued)

(52) U.S. Cl.
CPC ..... *F02D 41/0085* (2013.01); *F02D 35/024* (2013.01); *F02D 41/008* (2013.01); *F02D 41/1402* (2013.01); *F02D 41/1441* (2013.01); *F02D 41/1443* (2013.01); *F02D 41/1454* (2013.01); *F02D 41/2445* (2013.01); *F02D 41/2451* (2013.01); *F02D 41/2454* (2013.01); *F02D 41/2477* (2013.01); *F02D 41/3094* (2013.01); *F02D 41/3836* (2013.01); *F02D 41/18* (2013.01); *F02D 2200/0602* (2013.01); *F02D 2200/0616* (2013.01)

(58) Field of Classification Search
CPC ..... F02D 41/0085; F02D 41/008; F02D 41/1402; F02D 41/1441; F02D 41/1443; F02D 41/1454; F02D 41/2445; F02D 41/2451; F02D 41/2454; F02D 41/2477; F02D 41/3094; F02D 41/3836; F02D 41/18; F02D 35/024; F02D 2200/0602; F02D 2200/0616
USPC ..... 123/673, 674; 701/103
See application file for complete search history.

(56) References Cited

U.S. PATENT DOCUMENTS 6,732,041 B2 5/2004 Cullen
7,717,088 B2 5/2010 Thomas
(Continued)

*Primary Examiner* — Mahmoud Gimie
(74) *Attorney, Agent, or Firm* — Geoffrey Brumbaugh; McCoy Russell LLP

(57) ABSTRACT

Methods and systems are provided for learning a cylinder-to-cylinder air variation. During conditions when a PFDI engine is operated in a port-injection only mode, prior to port fuel injection, a direct-injection fuel rail pressure may be lowered via direct-injection. Then, prior to a spark event in a port-injected cylinder, the direct-injector may be transiently opened to use the rail pressure sensor for estimating a cylinder compression pressure, and inferring cylinder air charge therefrom.

22 Claims, 6 Drawing Sheets

(51) Int. Cl.

| | |
|---|---|
| ***F02D 41/30*** | (2006.01) |
| ***F02D 41/00*** | (2006.01) |
| ***F02D 35/02*** | (2006.01) |
| ***F02D 41/38*** | (2006.01) |
| *F02D 41/18* | (2006.01) |

(56) References Cited

U.S. PATENT DOCUMENTS

| | | | | |
|---|---|---|---|---|
| 8,899,203 | B2 | 12/2014 | Thomas | |
| 9,470,159 | B2 | 10/2016 | Gottschalk et al. | |
| 9,631,573 | B2 | 4/2017 | Surnilla et al. | |
| 10,208,686 | B1 * | 2/2019 | Thomas | F02D 41/008 |
| 2008/0314359 | A1 | 12/2008 | Thomas | |
| 2010/0212640 | A1 | 8/2010 | Lucido et al. | |
| 2010/0280742 | A1 | 11/2010 | Gwidt et al. | |
| 2014/0067232 | A1 | 3/2014 | Hattar et al. | |

* cited by examiner

METHOD AND SYSTEM FOR CYLINDER IMBALANCE ESTIMATION

CROSS REFERENCE TO RELATED APPLICATION

The present application is a continuation of U.S. patent application Ser. No. 15/727,337, entitled "METHOD AND SYSTEM FOR CYLINDER IMBALANCE ESTIMATION," filed on Oct. 6, 2017. The entire contents of the above-referenced application are hereby incorporated by reference in its entirety for all purposes.

FIELD

The present description relates generally to methods and systems for controlling a vehicle engine to monitor the cylinder-to-cylinder imbalance in air-fuel ratio.

BACKGROUND/SUMMARY

Engine parameters such as air-fuel ratio (AFR) can be controlled to ensure improved engine performance leading to effective use of an exhaust catalyst and reduced exhaust emissions. In particular, cylinder-to-cylinder imbalances in air-fuel ratio can lead to inefficient engine operation and an increase in engine-out emissions. In addition, there may be torque imbalances between the engine cylinders which can result in NVH issues.

One way to determine AFR variation between engine cylinders is to sense engine exhaust gases via an oxygen sensor located downstream of an exhaust catalyst. By measuring the exhaust gas components, it may be determined if a given cylinder is running richer or leaner than other cylinders. Fuel and/or charge air parameters may then be adjusted based on the variation to produce an air-fuel mixture at a target air-fuel ratio. However, the oxygen sensor may be exposed to exhaust gases that are a combination of gases from different engine cylinders. Therefore, it may be difficult to accurately determine air-fuel variations between different engine cylinders. Further, engine exhaust system geometry for cylinders having a large number of cylinders may bias sensor readings toward output of one cylinder more than other cylinders. Consequently, it may be even more difficult to determine air-fuel imbalance for engines having more than a few cylinders. Still other approaches may include monitoring torque pulses on the crankshaft (or monitoring crankshaft acceleration at a desired AFR) and deriving a correlation between torque amplitude and combustion air-fuel ratio. However, in all of these approaches, it may be difficult to differentiate the air component of the error from the fuel component of the error.

One example approach for learning air-based errors is shown by Gottschalk et al in U.S. Pat. No. 9,470,159. Therein, a direct fuel injector is actuated open to deliver fuel into a cylinder. A drop in direct injection fuel line pressure is measured while the injector is open and is used, in addition with a transfer function, to estimate the air charge amount in the cylinder. By comparing the air charge estimated in this way for each cylinder, the air component of cylinder-to-cylinder AFR or torque variations can be learned.

However, the inventors herein have recognized potential issues with such an approach also. As one example, the estimation may be limited by the fuel line pressure sensor's range of resolution. For example, at low engine loads, when the fuel line pressure is low, the drop in fuel line pressure may not be significant enough to be reliably measured by the sensor. As another example, the measured drop in fuel line pressure may be affected by the location of the piston in the cylinder, specifically, based on whether the piston is at TDC or BDC of a compression stroke. As yet another example, it may be difficult to differentiate the drop in fuel line pressure due to a fuel-based error from the drop due to an air-based error.

In addition, exhaust gas recirculation (EGR) flow can corrupt the fuel pressure sensor output, and the air flow estimated based on the fuel pressure sensor output. In particular, based on the configuration of the intake manifold, as well as the intake location where the EGR is received, different cylinders may get different EGR flows, affecting individual cylinder air charge estimations.

The inventors herein have recognized the shortcomings discussed above and have developed a method for determining air-fuel ratio imbalance and air-based error in engine cylinders taking into account AFR variations among cylinder groups. In one example, AFR imbalance may be determined by a method for an engine, comprising: injecting fuel from a direct injector, with a high pressure pump disabled, to reduce a direct injection fuel rail pressure below a threshold pressure; and then, injecting fuel into a cylinder and commanding the direct injector to selectively open a threshold duration before a spark event in the cylinder, without injecting any fuel from the direct injector. In this way, an air component of a cylinder AFR variation may be accurately learned and reliably differentiated from a fuel component of the AFR variation.

As one example, when operating a port fuel direct injection (PFDI) engine in a PFI only mode, an engine controller may estimate a compression pressure of the cylinder via a pressure sensor coupled to a high pressure direct injection (DI) fuel rail. The estimated compression pressure may then be used to infer the air charge of the cylinder. Specifically, the controller may disable a high pressure pump (HPP) coupled to the DI fuel rail and then, before injecting fuel via the port injector, inject fuel via the direct injector to bleed the high pressure fuel rail to a threshold pressure (e.g., to a lower threshold). Then, port fuel injection may be enabled and immediately before spark is delivered to the cylinder, the DI may be commanded open for a defined (short) duration. The high pressure fuel rail may become coupled to the cylinder, transiently, when the direct injector is opened, allowing the compression pressure in the cylinder to be estimated via the pressure sensor coupled to the high pressure fuel rail. In particular, the compression pressure may be noted as a transient spike in the fuel rail pressure. Since the compression pressure is directly related to the cylinder volume and the amount of air drawn into each cylinder, the spike in fuel rail pressure may be correlated with the air charge in that cylinder. By continuing this operation until the air charge in each cylinder is estimated, and by repeating this operation several times for each cylinder, a stable average pressure may be obtained for each cylinder. By comparing the values for each cylinder, the air component of cylinder-to-cylinder AFR variations may be learned. By performing the estimation when EGR flow is enabled and when EGR flow is disabled, the noise effect of EGR on the air-based error estimation can be quantified and compensated for.

Subsequently, the fuel rail pressure may be used for estimating the fuel component of the AFR variations. Therein, the HPP may be actuated to raise the DI fuel rail pressure to a threshold (e.g., an upper threshold), after which direct injection of fuel into the cylinder may be enabled, and a drop in fuel rail pressure following each injection pulse may be correlated with the pulse-width commanded on each pulse.

In this way, the method provides improved capability for learning air-fuel ratio imbalance. The technical effect of measuring a cylinder compression pressure to estimate cylinder air charge is that an air-based error among cylinder groups may be more accurately learned, and more accurately differentiated from a fuel-based error. By measuring a rise in DI fuel rail pressure during conditions when the cylinder is only fueled with port injection, the effect of the cylinder's compression pressure on the fuel rail pressure can be learned in a stable region of the fuel rail pressure sensor over a wider range of engine loads, including at low engine load. Consequently, the approach ensures improved fuel efficiency and reduced emissions. In addition, the method can compensate for air-fuel ratio imbalance associated with EGR flow, enabling the learning to be performed over a wider range of engine operating conditions, and without compromising EGR usage. By learning the air-based error among cylinder groups, AFR errors may better learned and compensated for.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
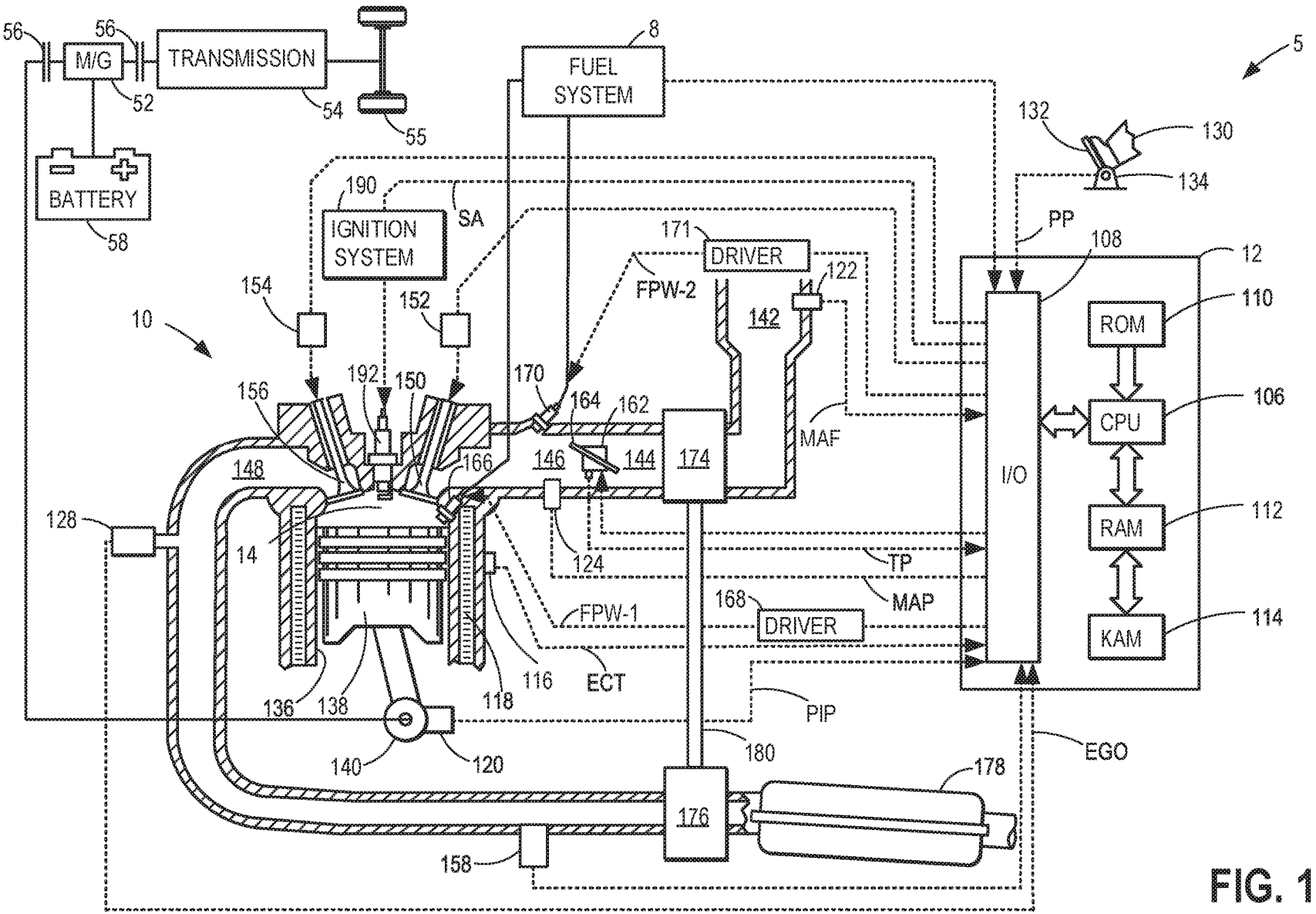
FIG. 1 is an illustration of an engine with a cylinder.
Figure 2:
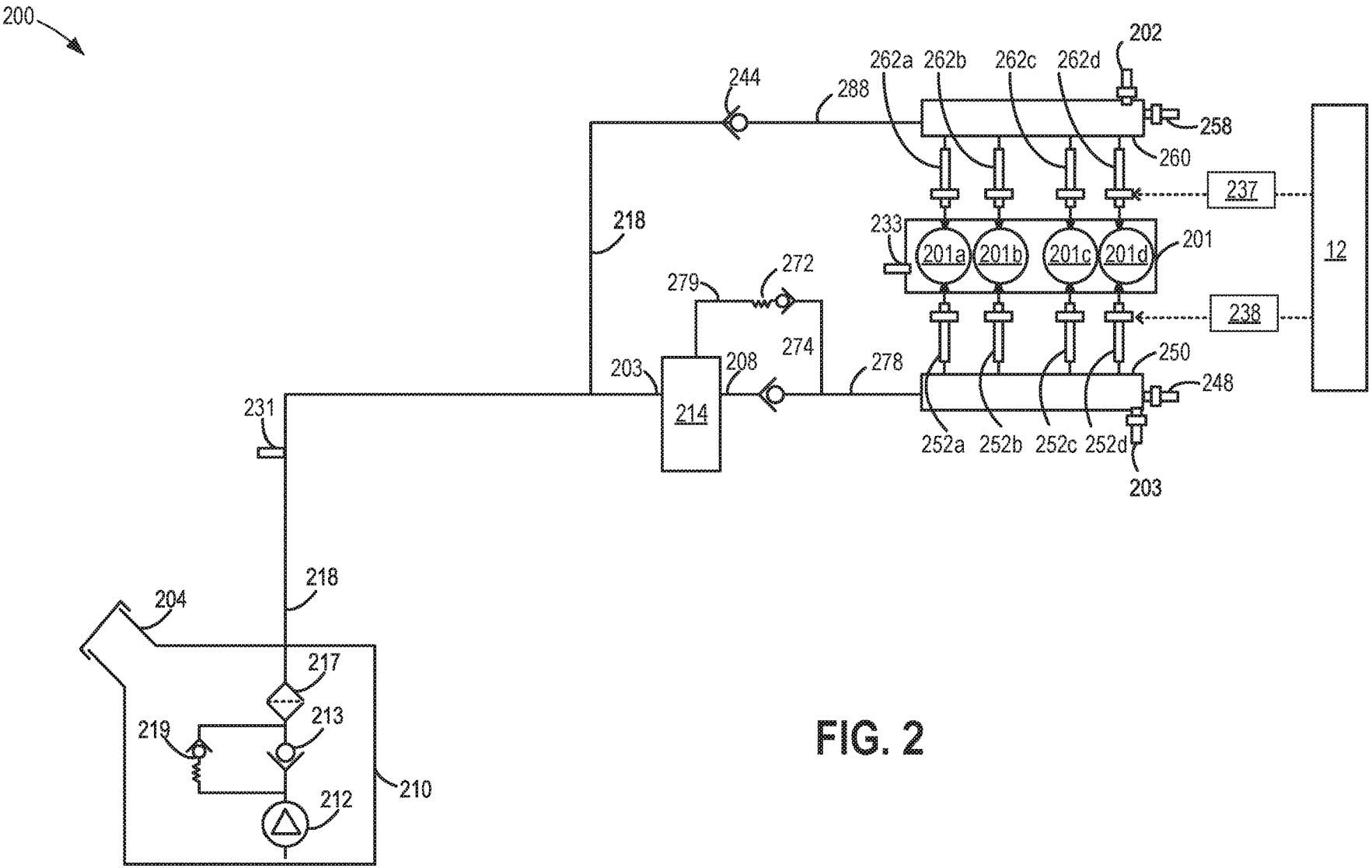
FIG. 2 shows a schematic diagram of a dual injector, single fuel system coupled to the engine of FIG. 1.

The following description relates to systems and methods for air-fuel error estimation in an engine system, such as the engine system of FIG. 1, configured for both port and direct injection, as shown in the fuel system of FIG. 2. An engine controller may be configured to perform a control routine, such as the example routine of FIGS. 3-4 to detect and differentiate an air component of cylinder-to-cylinder air-fuel ratio variation from a fuel component of the variation. The controller may adjust a timing of direct injector opening during a compression stroke of a combustion event, as shown at FIG. 5, to use a fuel rail pressure sensor for estimating a cylinder compression pressure, and inferring a cylinder air charge amount based on the estimated pressure. An example of air and fuel error estimation is shown with reference to FIG. 6.

FIG. 1 depicts an example embodiment of a combustion chamber (or cylinder) 14 of an internal combustion engine 10. Engine 10 may be coupled in a propulsion system, such as vehicle 5 configured for on-road travel.

Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to crankshaft 140 so that reciprocating motion of the piston is translated into rotational motion of the crankshaft. Crankshaft 140 may be coupled to at least one drive wheel 55 of the passenger vehicle via a transmission 54. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation.

Cylinder 14 of engine 10 can receive intake air via a series of intake air passages 142, 144, and 146. Intake air passage 146 can communicate with other cylinders of engine 10 in addition to cylinder 14. In some examples, one or more of the intake passages may include a boosting device, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 148. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 2, or may be alternatively provided upstream of compressor 174.

Exhaust passage 148 can receive exhaust gases from other cylinders of engine 10 in addition to cylinder 14. An exhaust gas sensor 128 is shown coupled to exhaust passage 148 upstream of an emission control device 178. Exhaust gas sensor 128 may be selected from among various suitable sensors for providing an indication of exhaust gas air/fuel ratio (AFR), such as a linear oxygen sensor or UEGO (universal or wide-range exhaust gas oxygen); a two-state oxygen sensor or EGO (as depicted); a HEGO (heated EGO); or a NOx, HC, or CO sensor, for example. Emission control device 178 may be a three way catalyst (TWC), a NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW-1 received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

Fuel injector 170 is shown arranged in intake passage 146 rather than coupled directly to cylinder 14 in a configuration that provides what is known as port injection of fuel (hereafter also referred to as "PFI") into an intake port upstream of cylinder 14. Fuel injector 170 may inject fuel received from fuel system 8 in proportion to the pulse width of a signal FPW-2 received from controller 12 via an electronic driver 171. Note that instead of multiple electronic drivers (such as electronic driver 168 for fuel injector 166 and electronic driver 171 for fuel injector 170, as depicted), a single electronic driver may be used for both fuel injectors.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered to cylinder 14 by both injectors during a single cycle of the cylinder. For example, each injector may deliver a portion of a total fuel amount that is combusted in cylinder 14. Further, the distribution and/or relative amount of fuel delivered by each injector may vary with operating conditions, such as engine load, knock, and exhaust temperature. The port injected fuel may be delivered during an open intake valve event, a closed intake valve event (e.g., substantially before the intake stroke), as well as during both open and closed intake valve operation. Similarly, directly injected fuel may be delivered at least partially during a previous exhaust stroke, during an intake stroke, and during a compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, such as one injector having a larger injection hole than the other, for example. Other differences include, but are not limited to, different spray angles, different operating temperatures, different targeting, different injection timing, different spray characteristics, different locations, etc. Moreover, depending on the distribution ratio of injected fuel among injectors 170 and 166, different effects may be achieved.

Fuel may be delivered to fuel injectors 166 and 170 by a high pressure fuel system including a fuel tank, fuel pumps, and fuel rails (elaborated at FIG. 2). Further, as shown in FIG. 2, the fuel tank and rails may each have a pressure transducer providing a signal to controller 12.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as Eli) (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. Moreover, fuel characteristics of one or both fuel tanks may vary frequently, for example, due to day to day variations in tank refilling.

An air-fuel ratio error may be determined based on the output of oxygen sensor 128. In addition to a given cylinder's air-fuel ratio error, there may be variation in air-fuel ratio, and thereby torque output, between individual cylinders. This may be due to differences in an air charge received to the cylinder, such as due to inherent differences in air flow due to the configuration/design of the intake manifold, runner lengths, valve position, and the location of each cylinder on an engine block. Additionally or alternatively, the variation may be due to differences in fuel received at the cylinder, such as due to inherent differences in injector nozzle shape and size, injector location, other injector differences, fuel rail pressure pulsations, etc. As elaborated with reference to FIGS. 3-4, torque variations due to the air component may be detected and differentiated from the fuel component of the variations, enabling each error to be appropriately addressed. In particular, during selected conditions, a fuel rail pressure sensor coupled to a high pressure fuel rail of the direct injector, as elaborated at FIG. 2, may be leveraged to measure the compression pressure of a cylinder and infer an air charge amount based on the compression pressure. During other conditions, a drop in fuel rail pressure following each direct injection event may be used to learn differences between a commanded fuel volume and a fuel volume actually delivered to a cylinder.

Controller 12 is shown in FIG. 1 as a microcomputer, including microprocessor unit 106, input/output ports 108, an electronic storage medium for executable programs (e.g., executable instructions) and calibration values shown as non-transitory read only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 148; a profile ignition pickup signal (PIP) from a Hall effect sensor 120 (or other type) coupled to crankshaft 140; throttle position (TP) from a throttle position sensor; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature. Controller 12 receives signals from the various sensors of FIG. 1 and employs the various actuators of FIG. 1 to adjust engine operation based on the received signals and instructions stored on a memory of the controller. For example, responsive to an indication of air error, as determined at FIG. 3, the controller may adjust engine fueling to maintain a target air-fuel ratio. In one example, responsive to an air error wherein more air than desired is delivered to an engine cylinder, the controller may increase a pulse width of fuel injected to that cylinder so as to maintain combustion air-fuel ratio at or around stoichiometry.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

FIG. 2 illustrates a dual injector, single fuel system 200 with a high pressure and a low pressure fuel rail system. Fuel system 200 may be coupled to an engine, such as engine 10 of FIG. 1, and operated to deliver fuel to the engine. Fuel system 200 may be operated by a controller to perform some or all of the operations described with reference to the method of FIGS. 3-4. Components previously introduced are similarly numbered.

Fuel system 200 may include fuel tank 210, low pressure or lift pump 212 that supplies fuel from fuel tank 210 to high pressure fuel pump 214. Lift pump 212 also supplies fuel at a lower pressure to low pressure fuel rail 260 via fuel passage 218 (herein also known as fuel line 218). Thus, low pressure fuel rail 260 is coupled exclusively to lift pump 212. Fuel rail 260 supplies fuel to port injectors 262*a*, 262*b*, 262*c* and 262*d*. High pressure fuel pump 214 supplies pressurized fuel to high pressure fuel rail 250. Thus, high pressure fuel rail 250 is coupled to each of high pressure pump 214 and lift pump 212.

Fuel injectors may need to be intermittently calibrated for variability due to age and wear and tear, as well as to learn a fuel component of injector-to-injector air-fuel ratio variability. As a result of the variation, the actual amount of fuel injected to each cylinder of an engine may not be the desired amount and discrepancies may lead to reduced fuel economy, increased tailpipe emissions, and an overall decrease in engine efficiency.

High pressure fuel rail 250 supplies pressurized fuel to direct fuel injectors 252*a*, 252*b*, 252*c*, and 252*d*. The fuel rail pressure in fuel rails 250 and 260 may be monitored by pressure sensors 248 and 258 respectively. Lift pump 212 may be, in one example, an electronic return-less pump system which may be operated intermittently in a pulse mode. In another example, lift pump 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lift pump motor can be obtained from an alternator or other energy storage device on-board the vehicle (not shown), whereby the control system can control the electrical load that is used to power the lift pump 212. Thus, by varying the voltage and/or current provided to the lift pump, the flow rate and pressure of the fuel provided at the inlet of the HP fuel pump 214 is adjusted.

Lift pump 212 may be equipped with a check valve 213 so that the fuel line 218 (or alternate compliant element) holds pressure while lift pump 212 has its input energy reduced to a point where it ceases to produce flow past the check valve 213. Lift pump 212 may be fluidly coupled to a filter 217, which may remove small impurities contained in the fuel that could potentially damage fuel handling components. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar or 5 bar (g). In some embodiments, fuel system 200 may include one or more (e.g., a series) of check valves fluidly coupled to low-pressure fuel pump 212 to impede fuel from leaking back upstream of the valves.

A lift pump fuel pressure sensor 231 may be positioned along fuel passage 218 between lift pump 212 and HP fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212.

High pressure fuel rail 250 may be coupled to an outlet 208 of high pressure fuel pump 214 along fuel passage 278. A check valve 274 and a pressure relief valve 272 (also known as pump relief valve) may be positioned between the outlet 208 of the high pressure fuel pump 214 and the high pressure fuel rail 250. The pump relief valve 272 may be coupled to a bypass passage 279 of the fuel passage 278. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. The pump relief valve 272 may limit the pressure in fuel passage 278, downstream of high pressure fuel pump 214 and upstream of high pressure fuel rail 250. For example, pump relief valve 272 may limit the pressure in fuel passage 278 to 200 bar. Pump relief valve 272 allows fuel flow out of the DI fuel rail 250 toward pump outlet 208 when the fuel rail pressure is greater than a predetermined pressure.

Attached at the inlet of the LP fuel rail is a check valve 244 for controlling fuel flow from the lift pump to the fuel rail and from the fuel rail to the lift pump. The pressure check valve 244 opens upon the fuel pump delivering a predetermined pressure to the fuel line.

Direct fuel injectors 252*a*-252*d* and port fuel injectors 262*a*-262*d* inject fuel, respectively, into engine cylinders 201*a*, 201*b*, 201*c*, and 201*d* located in an engine block 201. Each cylinder, thus, can receive fuel from two injectors where the two injectors are placed in different locations. For example, as discussed earlier in FIG. 1, one injector may be configured as a direct injector coupled so as to fuel directly into a combustion chamber while the other injector is configured as a port injector coupled to the intake manifold and delivers fuel into the intake port upstream of the intake valve. Thus, cylinder 201*a* receives fuel from port injector 262*a* and direct injector 252*a* while cylinder 201*b* receives fuel from port injector 262*b* and direct injector 252*b*.

While each of high pressure fuel rail 250 and low pressure fuel rail 260 are shown dispensing fuel to four fuel injectors of the respective injector group 252*a*-252*d* and 262*a*-262*d*, it will be appreciated that each fuel rail 250, 260 may dispense fuel to any suitable number of fuel injectors.

Similar to FIG. 1, the controller 12 may receive fuel pressure signals from fuel pressure sensors 258 and 248 coupled to fuel rails 260 and 250, respectively. Fuel rails 260 and 250 may also contain temperature sensors for sensing the fuel temperature within the fuel rails, such as sensors 202 and 203 coupled to fuel rails 260 and 250, respectively. Controller 12 may also control operations of intake and/or exhaust valves or throttles, engine cooling fan, spark ignition, injector, and fuel pumps 212 and 214 to control engine operating conditions.

Fuel pumps 212 and 214 may be controlled by controller 12 as shown in FIG. 2. Controller 12 may regulate the amount or speed of fuel to be fed into fuel rails 260 and 250 by lift pump 212 and high pressure fuel pump 214 through respective fuel pump controls (not shown). Controller 12 may also completely stop fuel supply to the fuel rails 260 and 250 by shutting down pumps 212 and 214.

Injectors 262*a*-262*d* and 252*a*-252*d* may be operatively coupled to and controlled by controller 12. An amount of fuel injected from each injector and the injection timing may be determined by controller 12 from an engine map stored in the controller 12 on the basis of engine speed and/or intake throttle angle, or engine load. Each injector may be controlled via an electromagnetic valve coupled to the injector (not shown). In one example, controller 12 may individually actuate each of the port injectors 262 via a port injection driver 237 and actuate each of the direct injectors 252 via a direct injection driver 238. The controller 12, the drivers 237, 238 and other suitable engine system controllers can comprise a control system. While the drivers 237, 238 are shown external to the controller 12, it should be appreciated that in other examples, the controller 12 can include the drivers 237, 238 or can be configured to provide the functionality of the drivers 237, 238.

In one example, the amount of fuel to be delivered via port and direct injectors is empirically determined and stored in a predetermined lookup tables or functions. For example, one table may correspond to determining port injection amounts and one table may correspond to determining direct injections amounts. The two tables may be indexed to engine operating conditions, such as engine speed and engine load, among other engine operating conditions. Furthermore, the tables may output an amount of fuel to inject via port fuel injection and/or direct injection to engine cylinders at each cylinder cycle.

Accordingly, depending on engine operating conditions, fuel may be injected to the engine via port and direct injectors or solely via direct injectors or solely port injectors. For example, controller 12 may determine to deliver fuel to the engine via port and direct injectors or solely via direct injectors, or solely via port injectors based on output from predetermined lookup tables as described above.

Various modifications or adjustments may be made to the above example systems. For example, the fuel passage 218 may contain one or more filters, pressure sensors, temperature sensors, and/or relief valves. The fuel passages may include one or more fuel cooling systems.

In this way, the components of FIGS. 1-2 enables an engine system comprising an engine including a cylinder; a port injector coupled to the cylinder; a direct injector coupled to the cylinder; a high pressure fuel pump delivering fuel to the direct injector via a direct injection fuel rail; a pressure sensor for estimating a direct injection fuel rail pressure; and a controller. The engine system may further include a controller configured with computer readable instructions stored on non-transitory memory for operating the direct injector with the fuel pump disabled until the fuel rail pressure falls below a first threshold pressure, and then disabling the direct injector; transiently opening the direct injector during a compression stroke, but before a spark event, of the cylinder, without delivering any fuel; estimating cylinder air-charge based on a change in fuel rail pressure during the transient opening; and adjusting subsequent cylinder fueling based on the estimated cylinder air-charge. In one example, the transiently opening is performed for a predefined number of injection events of the cylinder, wherein the estimated cylinder air-charge is an average cylinder air-charge averaged over the predefined number of injection events, and wherein adjusting subsequent cylinder fueling includes adjusting subsequent cylinder fueling via one or more of the port injector and the direct injector. In a further example, the cylinder may be one cylinder of a plurality of engine cylinders, wherein the fueling and transiently opening is performed for each of the plurality of engine cylinders over a number of consecutive injection events of the cylinder, and wherein adjusting subsequent cylinder fueling based on the estimated cylinder air-charge includes adjusting subsequent fueling for each engine cylinder based on the estimated cylinder air-charge of a corresponding cylinder relative to an average cylinder air-charge estimate, averaged over the plurality of engine cylinders. Further, the transiently opening may be performed while fueling the cylinder via the port injector only or during a deceleration fuel shut-off event.

Figure 3:
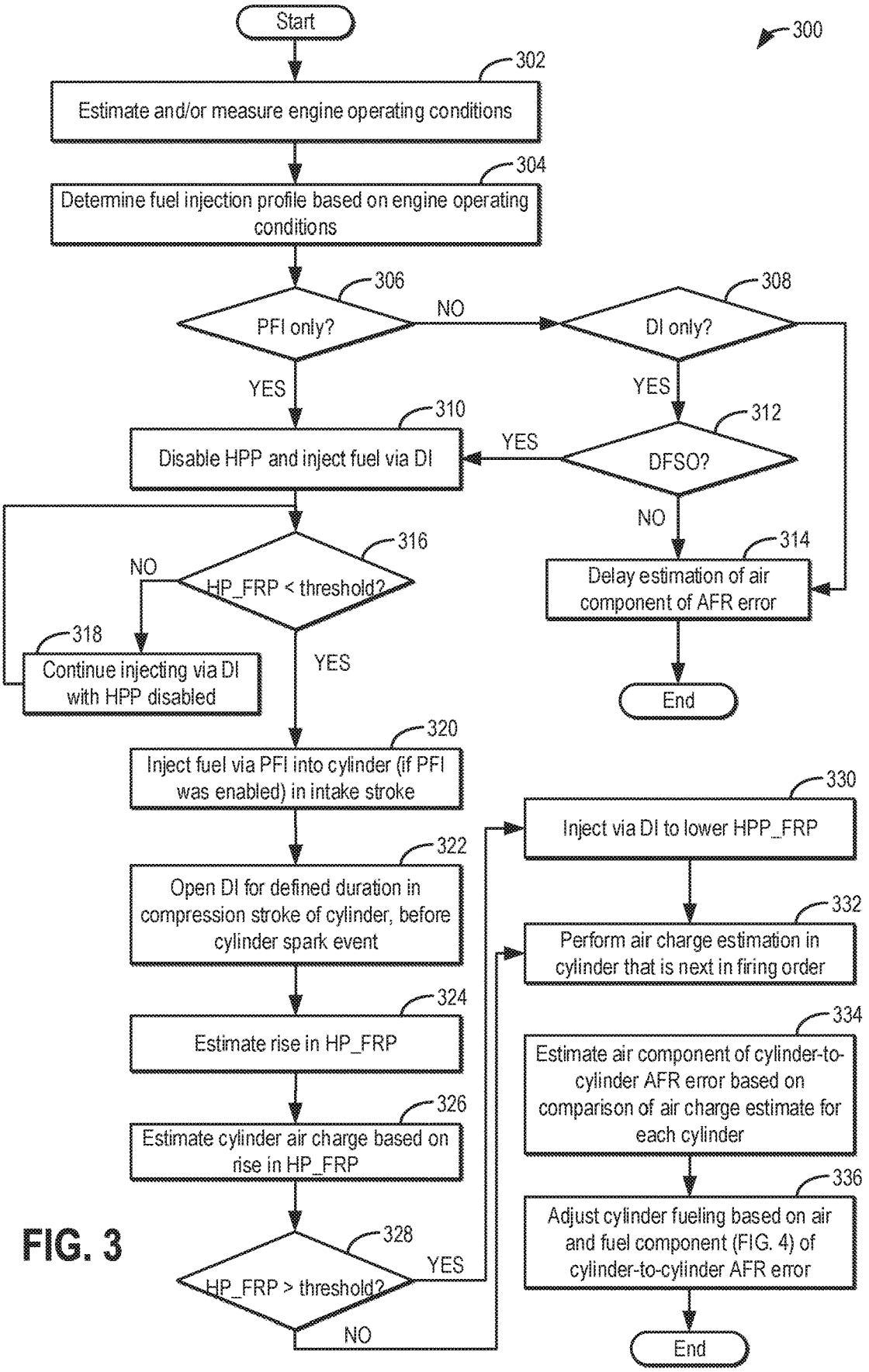
FIG. 3 shows a high-level flowchart of an example method for estimating an air component of a cylinder-to-cylinder air-fuel ratio variation.

Turning now to FIG. 3, an example method 300 is shown for learning an air component of an air-fuel ratio error between cylinders. The method enables cylinder-to-cylinder torque variations to be reduced by compensating for the learned air error, such as using fueling adjustments. Instructions for carrying out method 300 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 302, the method includes estimating and/or measuring engine operating conditions. For example, parameters such as engine speed, engine load, operator torque demand, boost pressure, engine dilution (e.g., EGR flow) ambient conditions such as ambient temperature, barometric pressure, ambient temperature, etc. may be determined.

At 304, the method includes determining a fuel injection profile based on the estimated engine operating conditions. Determining the fuel injection profile may include determining whether fuel is to be delivered via port injection, direct injection, or a combination thereof. Further, an amount of fuel, injection timing, number of injections per injection event, etc. may also be determined. For example, the engine controller may determine a fuel split ratio (including a ratio of port injected fuel to direct injected fuel) based on engine speed/load conditions. The controller may refer to an engine speed/load map stored in the controller's memory to determine an amount of fuel to be injected, a fuel injection type (or types), as well as a number of injections. In the case of a direct injection, the controller may further determine a ratio of intake stroke direct injected fuel relative to compression stroke direct injected fuel. In one example, at lower engine speed/loads, and cooler engine conditions, the fuel injection profile may include all of the injected fuel delivered via a single port injection in an exhaust stroke or an intake stroke. As another example, at higher engine speed/loads and warmer engine conditions, the fuel injection profile may include all of the injected fuel delivered via multiple direct injections in an intake stroke and/or a compression stroke. As yet another example, at mid speed-loads, a portion of the fuel may be delivered via port injection, and a remainder of the fuel may be delivered via (single or multiple) direct injections.

At 306, it may be determined if the fuel injection profile includes only port fuel injection (PFI only). If yes, then at 310, the method includes disabling a high pressure pump coupled to the direct injectors via a direct injection fuel rail. A lift pump supplying fuel from a fuel tank to the high pressure pump, and also to the port injectors via a port injection fuel rail may continue to operate. The direct injection fuel rail may be a high pressure fuel rail while the port injection fuel rail may be a low pressure fuel rail. Further, with the high pressure pump disabled, fuel may be injected from the direct injectors to reduce the direct injection fuel rail pressure below a threshold pressure. For example, the controller may command a pulse-width (e.g., a single command or intermittently repeating commands) to the direct injectors to enable the fuel rail pressure to be bled down. The direct injections used to bleed down the fuel rail pressure may be intake stroke direct injections. The injected fuel is then binned against the required fuel mass to achieve the desired air-fuel ratio. For example, the direct injections used to bleed down the fuel rail pressure may be compensated for via port injection adjustments (such as by providing a remainder of the required fuel mass via port injection) to maintain a target air-fuel ratio.

At 306, it may be determined if a fuel rail pressure at the high pressure fuel rail (HP_FRP) is lower than a threshold pressure. The threshold pressure may be determined as a function of barometric pressure and in one example, may be 100 psi. The threshold pressure may be further calibrated as a function of engine speed and load so that the air error can be estimated reliably via changes in fuel rail pressure even during low load engine operation. In one example, the threshold pressure is a lower threshold below which actuation (or opening) of the direct injector results in no fuel flowing out of the injector into the corresponding cylinder. For example, the threshold pressure may be lowered below a compression pressure expected in the cylinder during a cylinder combustion event. Since cylinder pressure near TDC prior to combustion is a direct function of load, as load increases, the resultant cylinder pressure will also increase. Thus in another example, the controller may target the same fuel rail pressure or scale the pressure based on load (cylinder pressure) to keep the same expected offset. For example, the controller may make a logical determination regarding the threshold pressure based on logic rules, a model, or an algorithm that uses the engine speed and load as input and generates the threshold pressure as an output. If the fuel rail pressure is not below the threshold pressure, then at 318, the method includes continuing to inject fuel via direct injection with the high pressure pump (HPP) disabled until the threshold pressure is reached. After reducing the fuel rail pressure below the threshold pressure, the direct injectors may be disabled. Then, at 320, the method includes port injecting fuel into a cylinder. In one example, port injecting fuel into the cylinder includes port injecting during an intake stroke or an (immediately preceding) exhaust stroke of the cylinder. It will be appreciated that port injecting fuel into the cylinder includes not direct injecting fuel into the cylinder and maintaining the HPP disabled.

At 322, the method includes commanding the direct injector to selectively open a threshold duration before a spark event in the cylinder, without injecting any fuel from the direct injector. In particular, the direct injector is commanded to open during a compression stroke of the cylinder. Opening a threshold duration before a spark event may include opening a threshold crank angle degrees before the spark event. Further, the direct injector may be held open for a defined duration, such as for a defined number of crank angle degrees. The threshold duration before a spark event or the engine position at which the DI is commanded open may be based on engine speed. Therein the number of crank degrees at which the DI is commanded open is adjusted as a function of speed. In one example, the DI is commanded open 5 degrees before the spark event and is held open for a few milliseconds, until sufficient time has elapsed that a stable pressure measurement can be taken. As another example, opening a threshold duration before a spark event may include opening at a predefined initial engine position and closing at a predefined final engine position. In one example, the DI is commanded open at 15 degrees BTDC and is held open for a few milliseconds, until 10 degrees BTDC. Further, the timing of DI opening may be varied based on engine speed to enable spark tracking. For example, a timing of opening the DI may be adjusted based on engine speed such that the DI opening may be completed at 5 degrees before the spark event. In another example, a minimum pulse-width may be commanded to the direct injector. In still another example, the pulse-width commanded to the DI may be adjusted based on the range and sensitivity of the fuel rail pressure sensor such that the DI is opened for enough time for the sensor to detect a measurable change.

For example, the controller may make a logical determination (e.g., regarding a timing of commanding the DI open) based on logic rules that are a function of engine speed and a timing of the cylinder spark event. The controller may use a model, a look-up table, or an algorithm that uses the engine speed as an input and that generates the engine position in CAD at which the DI is to be commanded open as an output. The controller may then generate a control signal, such as a pulse-width signal that is sent to the fuel injector actuator to open the DI at the determined engine position. As a result of opening the DI before the spark event in the port fueled cylinder, the compression pressure of the cylinder can be measured by the direct injection fuel rail pressure sensor. As used herein, the compression pressure of the cylinder refers to the pressure in the cylinder in the compression stroke, immediately prior to the combustion process. Since the combustion pressure is directly related to the cylinder volume and the amount of air pulled into the cylinder, by transiently coupling the cylinder to the DI fuel rail via the opening of the DI, the existing DI fuel rail pressure sensor can be used for accurately estimating cylinder air charge amount. As a result of transiently opening the DI, the pressure in the DI fuel rail increases. In one example, the fuel rail pressure may rise from 100 psi to 150 psi. As such, any air that is ingested from the cylinder into the fuel rail may dissolve with fuel in the fuel rail. At 324, the rise in the fuel rail pressure (HP_FRP) is estimated via the DI fuel rail pressure sensor. Various engine operating conditions or events may affect fuel rail pressure measurements and may be taken into consideration when calculating the fuel pressure rise attributed to each DI opening event. Therefore, in some examples, the routine may correlate fuel pressure to various engine operating conditions sensed via various sensors. For example, the transient pressure pulsations generated by injector opening may temporarily affect fuel rail pressure measurement, thus affecting the calibration accuracy. As such, the sampling of the fuel pressure may be selected to reduce the transient effects of injector firing. Additionally, or alternatively, if the injector firing timing is correlated to the fuel rail pressure measurement, temporary pressure changes caused by the injector firing may be taken into consideration when determining injector calibration values. Similarly, intake and/or exhaust valve opening and closing, intake pressure and/or exhaust pressure, crank angle position, cam position, spark ignition, and engine combustion, may also affect fuel rail pressure measurements and may be correlated to the fuel rail pressure measurements to accurately calculate fuel rail pressure rise attributed to individual cylinder events.

At 326, the method includes learning a cylinder air-fuel error based on the rise in the fuel rail pressure following the selective opening of the direct injector. In particular, the controller may learn an air-charge estimate for the cylinder based on the rise in the fuel rail pressure. The air charge may be determined as a function of the injector flow characteristics, pulse width, and air density according to the equation: Charge[mass]=(flowrate/duration)*density.

The learning may be continued over multiple consecutive combustion events. For example, the controller may learn the air-charge estimate for each of a plurality of cylinders of the engine over a number of consecutive cylinder events, while the engine operates in the PFI only mode. The controller may then determine an average air-charge estimate for the engine by averaging the estimate for the plurality of cylinders. In addition, the learning may be performed in each of the plurality of cylinders over a number of combustion events in each given cylinder. The controller may estimate an air-charge for each cylinder iteratively over the number of combustion events and determine an average air-charge estimate for the cylinder.

As indicated earlier, over each event, the DI fuel rail pressure may rise. For example, over consecutive events, the fuel rail pressure may gradually rise from 100 psi to 200 psi. At 328, it may be determined if the fuel rail pressure is higher than a threshold pressure, such as an upper threshold above which fuel may be inadvertently injected into the cylinder when the DI is commanded open. In one example, the upper threshold pressure is 500 psi. Thus the learning may be continued until the fuel rail pressure is above the upper threshold pressure. Then at 3330, the method includes, with the HPP maintained disabled, injecting fuel from the direct injector (e.g., in the intake stroke) to reduce the fuel rail pressure to the lower threshold pressure, and then at 332, resuming the learning after the fuel rail pressure is below the lower threshold pressure. For example, the controller may move to performing an air charge estimation in a cylinder that is next in the engine firing order. Else, if the upper threshold is not reached at 328, the method moves to 332 directly and continues the learning. While direct injection is used to reduce the fuel rail pressure, the port injection fuel mass may be reduced to maintain a desired fuel mass to achieve a targeted air-fuel ratio.

At 334, the method includes estimating an air component of a cylinder-to-cylinder air-fuel ratio (AFR) error based on a comparison of the air-charge estimate for each cylinder. For example, the controller may learn the air component of the cylinder AFR error based on a deviation between the air-charge estimates (e.g., the average air-charge estimate) of each cylinder. As one example, the average air-charge estimate of a first engine cylinder may be compared to the average air-charge estimate of a second engine cylinder (such as a cylinder firing next in the firing order) and the air component of the AFR error of the first or second cylinder may be determined based on a difference between them. As another example, the average air-charge estimate of a first engine cylinder may be compared to the average air-charge estimate across all engine cylinders and the air component of the AFR error for the first cylinder may be determined based on a difference between them. For example, several samples may be taken from each cylinder. Those samples may then be averaged. The overall engine air-charge is then defined by the average of all the cylinders. The error for each cylinder is then calculated based on the individual cylinder average versus the overall engine average.

At 336, the method includes adjusting cylinder fueling based on the air component and further based on the fuel component of the AFR error. As elaborated at FIG. 4, a fuel component of the air error may be learned by correlating changes in fuel rail pressure following each of a series of direct injections of fuel into a cylinder. By learning the air component different from the fuel component of the AFR error, each error may be compensated for accordingly. In one example, the controller may increase cylinder fueling for a cylinder as the learned air-charge estimated exceeds an expected air-charge estimate (or the average estimate). As another example, the controller may decrease cylinder fueling for a cylinder as the learned air-charge estimated falls below the expected air-charge estimate (or the average estimate). In further examples, other engine torque actuators may be adjusted based on the learned air error. For example, valve timing may be adjusted based on the learned air error.

Returning to 306, if the engine is not in a PFI only mode, then at 308, it may be determined if the engine is in a DI only mode. If the engine is not in the DI only mode, that is, the engine is in a PFDI mode where the cylinders are fueled via each of port and direct injection, the method moves to 314 to delay the estimation of the air component of the AFR error. This is because the PFI only mode provides the most stable data points for the air error estimation.

If the DI only mode is confirmed, at 312, it may be determined if a deceleration fuel shut-off (DFSO) event is present. During a DFSO, engine fueling is transiently discontinued while cylinder valve operation continues, causing the engine to spin unfueled. DFSO may be performed during low engine loads, such as responsive to a tip-out event, downhill vehicle travel, or during coasting, to reduce engine fuel consumption. If a DFSO is not confirmed, the method moves to 314 to delay the estimation of the air component of the AFR error. During the DI only mode, the HPP and the direct injectors are enabled and cylinder fueling is provided by commanding a pulse-width to the direct injectors based on the torque demand. If a DFSO is confirmed, then the method moves to 310 to disable the HPP, and inject fuel via the DI to reduce the fuel rail pressure. Thereafter, the estimation proceeds as discussed during the PFI only mode with the DI commanded open selectively before a cylinder spark event and the air-charge estimate of the cylinder inferred based on a rise in fuel rail pressure following the commanding.

It will be appreciated that the learning described in the method of FIG. 3 may be aborted responsive to a torque transient (such as a tip-in or tip-out) that changes the fuel injection profile. For example, responsive to a tip-in, the learning may be aborted and the controller may transition to fueling the engine via port and direct injection, or only direct injection. The learned air charge estimates may be saved in the controller's memory and thereafter the learning may remain suspended until the engine operating conditions favorable for the learning return. For example, the learning may be suspended until the engine is fueled via port injection only, at which point the routine may continue on from the last learned cylinder event, or restart from a defined start point.

In some examples, the method of FIG. 3 may be performed with EGR enabled and then with EGR disabled to learn a noise effect of EGR on the air estimation. For example, based on a location of EGR delivery into an engine intake, such as based on where and how an EGR passage is coupled to an intake passage, some engine cylinders may receive more or less EGR flow than other cylinders. Thus, by learning the effect of EGR on a cylinder's air-charge estimate, the air error may be better compensated. The compensation subsequently applied for a cylinder's air error may be different when EGR is enabled than when EGR is disabled. For example, once the fresh air-charge flow is calculated (without EGR, "cylinder aircharge_without EGR"), then the measurements may be taken again to determine the individual cylinder's EGR (with EGR enabled, "cylinder_EGR"). Since EGR displaces fresh air, the cylinders actual fresh air charge is then calculated based on the measured air charge without EGR and the measured EGR per cylinder. Specifically, the cylinder's actual fresh air charge ("Cylinder_fresh air) is determined as:

Cylinder_fresh air=cylinder aircharge_without EGR−cylinder_EGR.

Figure 4:
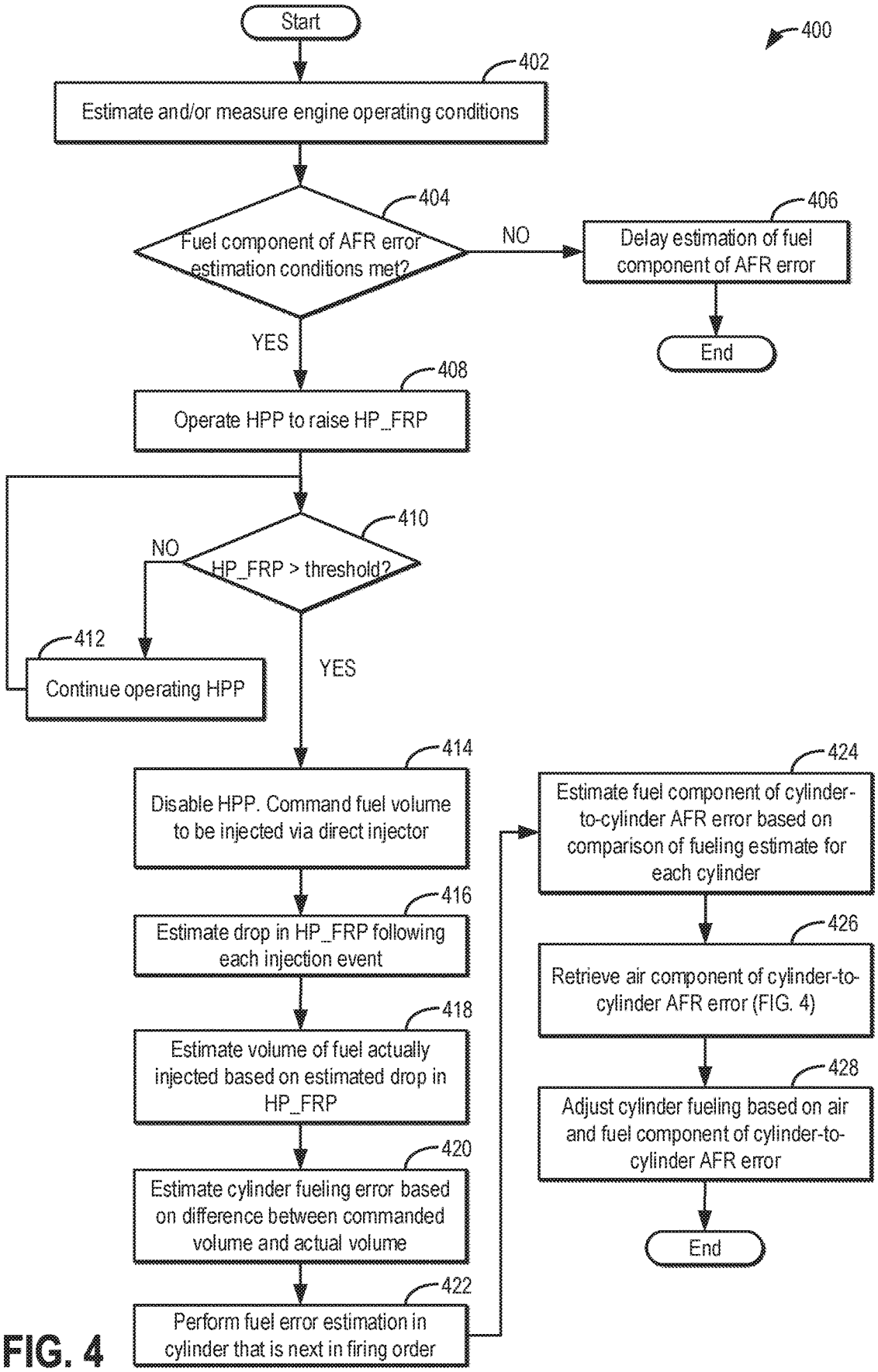
FIG. 4 shows a high-level flowchart of an example method for estimating a fuel component of a cylinder-to-cylinder air-fuel ratio variation.
Figure 5:
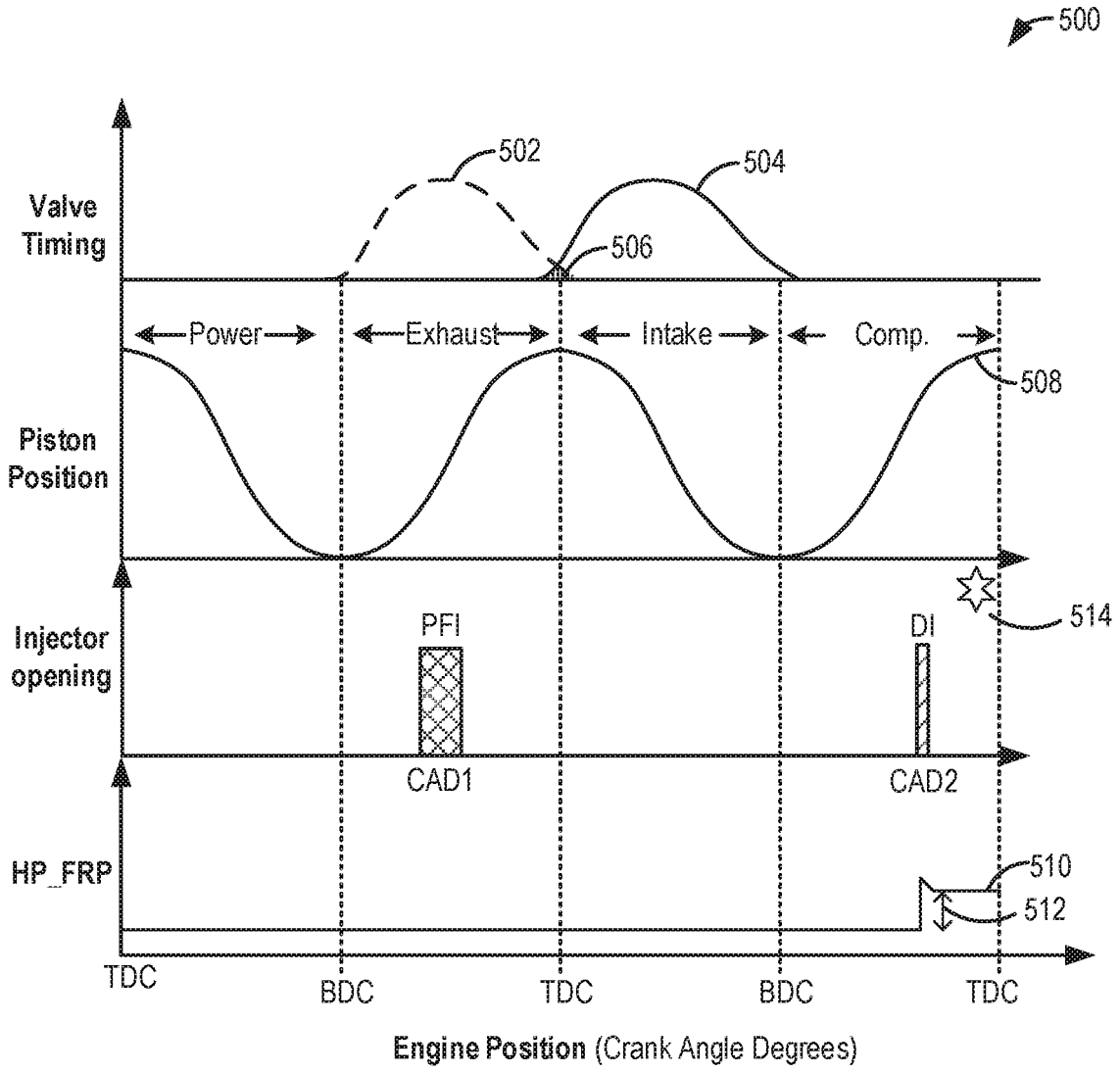
FIG. 5 depicts the timing of port injector and direct injector operation in a cylinder cycle relative to cylinder valve and spark events during estimation of cylinder air error.

Turning now to FIG. 4, an example method 400 is shown for learning a fuel component of an air-fuel ratio error between cylinders. The method enables cylinder-to-cylinder torque variations to be reduced by compensating for the learned air error, such as using fueling adjustments.

At 402, the method includes estimating and/or measuring engine operating conditions. For example, parameters such as engine speed, engine load, operator torque demand, boost pressure, engine dilution (e.g., EGR flow) ambient conditions such as ambient temperature, barometric pressure, ambient temperature, etc. may be determined. At 404, it may be determined if estimation conditions are present for determining the fuel component of an AFR error between engine cylinders. In one example, estimation conditions may be confirmed responsive to the engine being in a low load operating region (such as when engine speed and/or operator torque demand are below a threshold), engine temperature being greater than a threshold temperature (e.g., above 80° C.) that ensures injector calibration injection events are carried out when engine temperature is relatively stable, and a threshold duration or distance of engine operation having elapsed since a last estimation of the fuel error. If estimation conditions are not met, then at 406, the method delays the estimation of the fuel component of the AFR error. This is because the existing conditions cannot provide stable data points for the fuel error estimation. This may occur while the engine is in DI mode, PFI mode, or PFDI mode.

If estimation conditions are met, at 408, the method includes operating the HPP to raise the direct injection fuel rail pressure above a threshold pressure. As an example, the controller may increase the fuel rail pressure by issuing extra pump strokes to the HPP, increasing pump stroke frequency, and/or increasing a pump stroke for at least one stroke so that the fuel pressure in the high pressure fuel rail reaches a predetermined threshold calibration pressure. In one example, the threshold calibration pressure is an upper threshold pressure, such as 200 psi. HPP operation may be increased based on engine speed, engine load, boosting operation, intake charge pressure, a number of calibration injections (for the engine, or for each injector) and/or other operating conditions. At 410, the fuel rail pressure may be assessed relative to the threshold calibration pressure. If it is not reached, at 412, the method includes continuing HPP operation until the target fuel rail pressure is reached. Else, once the pressure is reached, at 414, the HPP may be disabled. Further, a fuel volume may be commanded to be injected via the direct injector into a first cylinder. The volume commanded may be based on fuel rail pressure and fuel density. In one example, the controller determines the desired fuel rail pressure and calculates the amount of fuel needed to be removed from the rail to achieve the target pressure. The fuel mass is converted to a volume based on the fuel density. The volume is then converted to a flow duration (i.e. pulse width) based on the injector flow characteristics. The controller may command a pulse-width to the direct injector based on the target volume to be delivered. As elaborated below, the controller may run a series of fuel injections in a predetermined sequence (e.g., injector #1, injector #2, injector #3, injector #4, or in a firing order as prescribed for the engine) and repeat the sequence for a predetermined number of times (e.g., 3 engine cycles, where each injector operates at least once during each engine cycle).

At 416, following injection in the first cylinder, the method includes estimating a drop in the high pressure fuel rail pressure following each injection event. Specifically, over each injection event, as fuel is delivered into a cylinder with the HPP disabled, the DI fuel rail pressure may drop. For example, over consecutive events, the fuel rail pressure may gradually drop from 200 psi to 100 psi. The controller may calculate the fuel pressure drop ($\Delta Pij$) due to each injection by the ith injector (e.g., j=1, 2, 3 . . . 9 if each injector is injected 3 times during a calibration injection cycle and the calibration injection cycle is run 3 times during a calibration event). $\Delta Pij$ corresponds to pressure drop in the DI fuel rail due to injection by ith injector during the jth injection. Various engine operating conditions or events may affect fuel rail pressure measurements and may be taken into consideration when calculating the fuel pressure drop ($\Delta Pij$) attributed to each injection. Therefore, in some examples, the routine may correlate fuel pressure to various engine operating conditions sensed via various sensors. For example, the transient pressure pulsations generated by injector firing may temporarily affect fuel rail pressure measurement, thus affecting the calibration accuracy. As such, the sampling of the fuel pressure may be selected to reduce the transient effects of injector firing. Additionally, or alternatively, if the injector firing timing is correlated to the fuel rail pressure measurement, temporary pressure drops caused by the injector firing may be taken into consideration when determining injector calibration values. Similarly, intake and/or exhaust valve opening and closing, intake pressure and/or exhaust pressure, crank angle position, cam position, spark ignition, and engine combustion, may also affect fuel rail pressure measurements and may be correlated to the fuel rail pressure measurements to accurately calculate fuel rail pressure drop attributed to individual injections.

At 418, the method includes estimating a volume of actually injected into a cylinder on each injection event based on the estimated drop in fuel rail pressure on that injection event. For example, the controller may calculate an amount of fuel actually injected in each injection Qij, using equation (1) as follows:

$$Qij=\Delta Pij/C \tag{1}$$

where C is a predetermined constant coefficient for converting the amount of fuel pressure drop to the amount of fuel injected. Further, the controller may determine the average amount of fuel actually injected by injector i (Qi) using equation (2) as follows:

$$Qi=(\Sigma_1^j Qij)/j \tag{2}$$

where j is number of injections by injector i (e.g., j=1, 2, 3 . . . 9 if each injector is injected 3 times during a calibration injection cycle and the calibration injection cycle is run 3 times during a calibration event).

At 420, a cylinder fueling error is determined based on a difference between the commanded volume (based on the pulse-width commanded to the direct injector) and the actual volume received in the cylinder (based on the corresponding drop in fuel rail pressure). AT 422, after determining the fueling error for a first cylinder, the controller moves to perform the fuel error estimation in a cylinder that is next in the firing order (or predetermined calibration sequence).

At 424, the method includes estimating a fuel component of a cylinder-to-cylinder AFR error based on a comparison of the fueling estimate (or fueling error) for each cylinder. In one example, the controller may calculate a correction coefficient for each fuel injector i (e.g., i=1, 2, 3, or 4 for a four cylinder engine) using equation (3) as follows:

$$ki=Qc/QI \quad (3)$$

The controller may renew the correction coefficient for injector i with the newly calculated ki. For example, the newly calculated ki will replace an old ki stored in a keep alive memory (KAM) of the control unit that may be currently used to calibrate injector i. In still other examples, the controller may learn the fuel component of the cylinder AFR error based on a deviation between the fuel error estimates of each cylinder. As one example, the average fuel error estimate of a first engine cylinder may be compared to the average fuel error estimate of a second engine cylinder (such as a cylinder firing next in the firing order) and the fuel component of the AFR error of the first or second cylinder may be determined based on a difference between them. As another example, the average fuel error of a first engine cylinder may be compared to the average fuel error across all engine cylinders and the fuel component of the AFR error for the first cylinder may be determined based on a difference between them.

At 426, the method includes retrieving the air component of the cylinder-to-cylinder AFR error from the controller's memory. The air error may be have been determined during a PFI only mode based on a rise in fuel rail pressure following opening of a DI prior to a cylinder spark event, as elaborated at FIG. 3.

At 428, the method includes adjusting cylinder fueling based on the air component and further based on the fuel component of the AFR error. By learning the air component different from the fuel component of the AFR error, each error may be compensated for accordingly. In one example, the controller may increase cylinder fueling for a cylinder as the learned fuel error increases. As another example, the controller may decrease cylinder fueling for a cylinder as the learned fuel error decreases. In further examples, other engine torque actuators may be adjusted based on the learned fuel error. For example, spark timing may be adjusted based on the learned fuel error. As another example, fuel rail pressure may be adjusted based on the learned fuel error. In some examples, each of the air error and the fuel error may be adjusted via fueling adjustments. In other example, air error may be compensated for via different adjustments (e.g., different torque actuators) as compared to the fuel error compensation. For example, spark may be used to adjust torque. As another example, EGR flow may be adjusted to alter the overall percent error (for example, by reducing the EGR flow rate from 10% to 5%). This will still allow some EGR benefit, without pushing the cylinder beyond the OBD threshold for being out of balance.

In this way, with a high pressure fuel pump disabled, an engine controller may learn an air component of cylinder torque variation based on a first change in direct injection fuel rail pressure upon commanding a direct injector to selectively open a threshold duration before a spark event in a cylinder that is fueled via port injection only. Then, the controller may learn a fuel component of the cylinder torque variation based on a second change in direct injection fuel rail pressure upon commanding the direct injector to open in a cylinder that is fueled via direct injection only. In one example, the first change in direct injection fuel rail pressure includes a rise in the fuel rail pressure while the second change in direct injection fuel rail pressure includes a drop in the fuel rail pressure. While learning the air component, the direct injector may be commanded to selectively open after the direct injection fuel rail pressure has been lowered to below a first threshold pressure. In comparison, during learning the fuel component, the direct injector may be commanded to open after the direct injection fuel rail pressure has been raised above a second threshold pressure. During both the learning the air component and the learning the fuel component, a high pressure fuel pump coupled to the direct injector is disabled. Further, during learning the air component, the engine may be fueled via port injection only while during the learning the fuel component, the engine may be fueled via direct injection only. In a PFDI engine, where the engine can be fueled via port and direct injection, the controller may fuel the engine via port injection only during the learning. If the engine is a DI engine, the engine will be fueled via direct injection even during the learning.

Turning now to FIG. 5, an example map 500 of valve timing and piston position, with respect to an engine position, for a given engine cylinder is shown, and a timing of direct injector opening for air-error estimation is depicted. During selected conditions, such as when a cylinder is fueled via port injection only, an engine controller may command a direct injector open to transiently couple the cylinder with the DI fuel rail (and its pressure sensor) without injecting fuel into the cylinder. An air-charge estimation error for the cylinder may then be inferred based on a change in the fuel rail pressure.

Map 500 illustrates an engine position along the x-axis in crank angle degrees (CAD). Curve 508 depicts piston positions (along the y-axis), with reference to their location from top dead center (TDC) and/or bottom dead center (BDC), and further with reference to their location within the four strokes (intake, compression, power and exhaust) of an engine cycle. As indicated by sinusoidal curve 508, a piston gradually moves downward from TDC, bottoming out at BDC by the end of the power stroke. The piston then returns to the top, at TDC, by the end of the exhaust stroke. The piston then again moves back down, towards BDC, during the intake stroke, returning to its original top position at TDC by the end of the compression stroke.

Curves 502 and 504 depict valve timings for an exhaust valve (dashed curve 502) and an intake valve (solid curve 504) during a normal engine operation. As illustrated, an exhaust valve may be opened just as the piston bottoms out at the end of the power stroke. The exhaust valve may then close as the piston completes the exhaust stroke, remaining open at least until a subsequent intake stroke has commenced. In the same way, an intake valve may be opened at or before the start of an intake stroke, and may remain open at least until a subsequent compression stroke has commenced.

As a result of the timing differences between exhaust valve closing and intake valve opening, for a short duration, before the end of the exhaust stroke and after the commencement of the intake stroke, both intake and exhaust valves may be open. This period, during which both valves may be open, is referred to as a positive intake to exhaust valve overlap 506 (or simply, positive valve overlap), represented by a hatched region at the intersection of curves 502 and 504. In one example, the positive intake to exhaust valve overlap 506 may be a default cam position of the engine present during an engine cold start.

The third plot (from the top) of map 500 depicts an example timing of fuel injector opening and closing during the cylinder event. Operation of the port injector is shown as a hatched block while operation of the direct injector is shown as a striped block. The fourth plot from the top of map 500, plot 510, depicts the fuel rail pressure of a high pressure fuel rail coupled to the direct injector.

In the depicted cylinder event, the cylinder is operated with the HPP coupled to the direct injector disabled, resulting in a lower than threshold fuel rail pressure (HP_FRP). An engine controller is configured to provide the total amount of fuel to the cylinder via a port injection in the exhaust stroke at CAD1. Then, in the compression stroke, before spark event 514 in the cylinder, the direct injector is commanded open for a short duration at CAD2. In the depicted example, a minimum pulse-width is commanded to the direct injector. Since the DI is commanded open when the fuel rail pressure is low, no fuel is direct injected into the cylinder. As a result of the opening of the DI, the cylinder's combustion chamber is transiently coupled to the DI fuel rail and the compression pressure of the cylinder is sensed via the DI fuel rail pressure sensor. In particular, a spike 512 in the fuel rail pressure is observed. Since the compression pressure is a function of the cylinder volume and air-charge, an air-charge estimate of the given cylinder may then be inferred based on the sensed spike 512 in fuel rail pressure. By then comparing the air-charge estimate of the given cylinder to the estimate of other engine cylinders, an air component of a cylinder-to-cylinder AFR error can be determined and compensated for.

Figure 6:
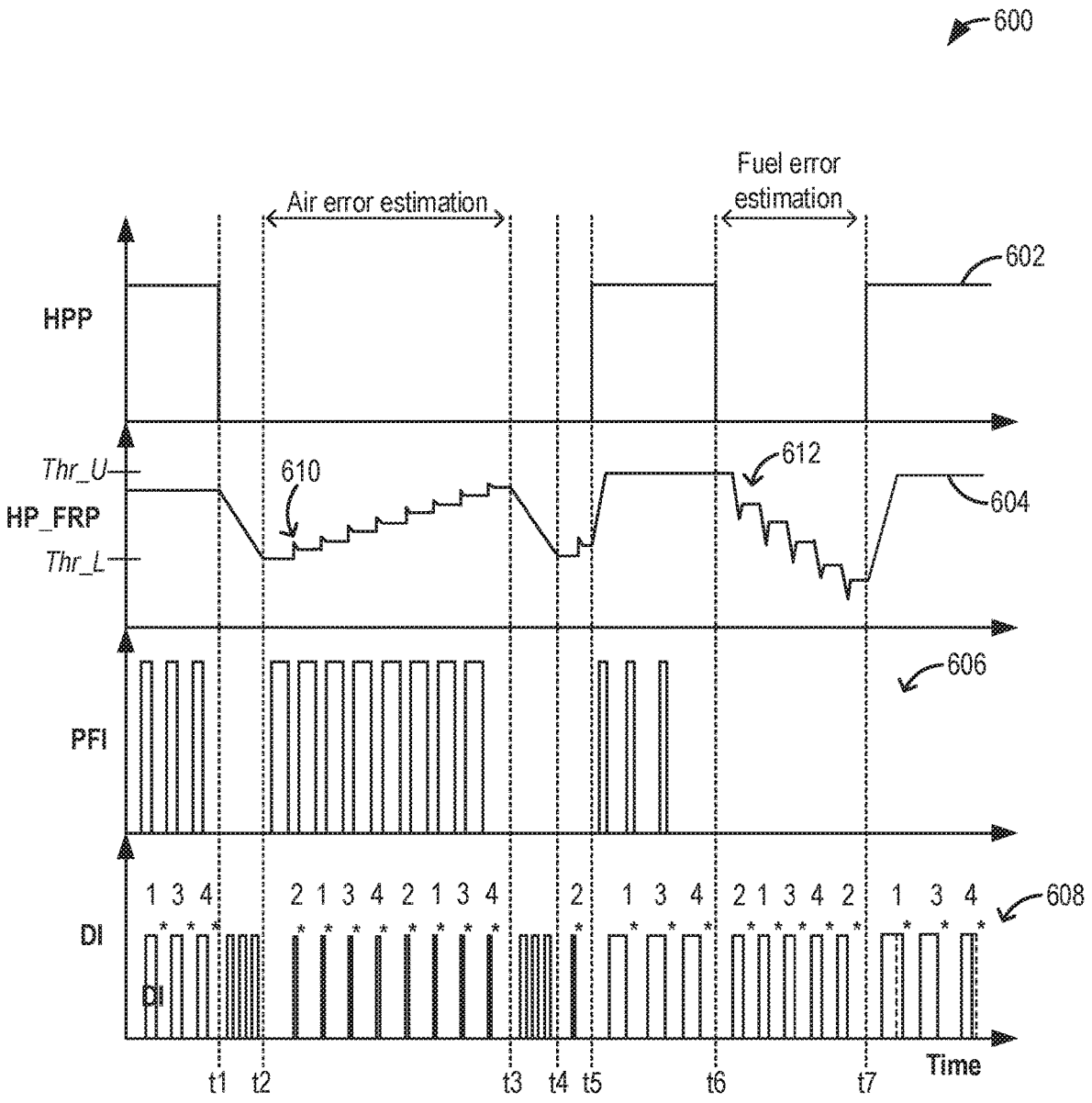
FIG. 6 depicts a prophetic example of estimation of cylinder-to-cylinder air-fuel error including determination of air and fuel components of the error.

An example engine air and fuel component error estimation is depicted with reference to FIG. 6. Map 600 depicts high pressure fuel pump operation at plot 602, high pressure (DI) fuel rail pressure at plot 604, pulse-width commanded to a port injector of a corresponding cylinder at plot 606, and pulse-width commanded to a direct injector of the corresponding cylinder at plot 608. All plots are depicted over time along the x-axis. Cylinder events are labeled (1-4) based on firing order (1-3-4-2 in the depicted example). Cylinder spark events are depicted by an asterisk. A position of the asterisk relative to the pulse-width commanded to at least the DI is indicative of relative spark timing.

Prior to t1, the engine is operating with each of a lift pump (not shown) and an HPP operating. At this time, the engine is fueled via each of port and direct injection. A split ratio of fuel delivered includes a higher ratio of PFI fuel relative to DI fuel, as shown by the difference in the commanded pulse-widths. At t1, there is a drop in operator torque demand (e.g., a tip-out event) responsive to which the engine is fueled via port injection only. Accordingly, at t1, the HPP is disabled. Air error estimation conditions are considered met. Between t1 and t2, the fuel rail pressure (FRP) is lowered to a lower threshold Thr_L for enabling air error estimation. The FRP is lowered by repeating injecting fuel via the DI, the controller commanding short (e.g., minimum) pulse-widths to the DI.

At t2, once the FRP is lowered, air estimation is initiated in the next firing cylinder (herein cylinder 2) by port injecting fuel during an exhaust stroke and then commanding the DI open just before the cylinder's spark event. The opening of the DI during the compression stroke results in no fuel being direct injected but results in a spike in fuel rail pressure depicted, for one cylinder, at 610. Similarly, over consecutive cylinder events between t2 and t3, air charge is estimated for each of cylinders 1-4 multiple times based on a rise in FRP following opening of the DI during a compression stroke of the cylinder, the cylinder fueled via port injection only.

At t3, the FRP reaches an upper threshold Thr_U from where a further rise in FRP cannot be reliably estimated. Therefore the learning is suspended and between t3 and t4 (as at t1 to t2), the fuel rail pressure (FRP) is lowered to lower threshold Thr_L by repeatedly injecting fuel via the DI, the controller commanding short (e.g., minimum) pulse-widths to the DI. At t4, once the FRP has been lowered to Thr_L, the learning is resumed. The learning includes learning an air-charge estimate for each cylinder based on a corresponding rise in FRP (e.g., 610) for that cylinder event. The air-charge estimate for each cylinder is then compared to each other to identify cylinders running leaner than intended or richer than intended.

At t5, there is a rise in operator torque demand (e.g., a tip-in event) responsive to which the engine is fueled via port and direct injection. Accordingly, at t5, the HPP is enabled. A split ratio of fuel delivered includes a higher ratio of DI fuel relative to PFI fuel, as shown by the difference in the commanded pulse-widths. Shortly before t6, there is a further rise in operator torque demand (e.g., another tip-in event) responsive to which the engine is fueled via direct injection only. The combustion event in cylinder 4, before t6, occurs with only direct injection of fuel.

At t6, fuel error estimation conditions are considered met. Since the FRP is already at or above the upper threshold pressure Thr_U, no further pump operation is required, and the HPP is disabled. Also, fuel estimation is initiated in the next firing cylinder (herein cylinder 2) by direct injecting a defined amount of fuel during an intake stroke and measuring a resultant drop in fuel rail pressure (depicted, for one cylinder, at 612). Similarly, over consecutive cylinder events between t6 and t7, fuel is estimated for each of cylinders 1-4 multiple times based on a drop in FRP following DI of fuel into the cylinder, the cylinder fueled via direct injection only. The learning includes learning a fueling estimate for each cylinder based on a corresponding drop in FRP (e.g., 612) for that cylinder event. The fuel estimate for each cylinder is then compared to a fuel volume based on the commanded pulse-width to identify cylinders running leaner than intended or richer than intended.

At t7, there is a rise in operator torque demand (e.g., a tip-in event) responsive to which the engine is fueled via direct injection only. Accordingly, at t7, the HPP is enabled and the learning is disabled. After t7, fueling for each cylinder is adjusted based on the learned air and fuel error component of each cylinder's cylinder-to-cylinder AFR variation. For example, fueling in cylinder 1 is increased by extending the pulse-width (compared to unadjusted shown in dashed lines). As another example, fueling in cylinder 4 is decreased by reducing the pulse-width (compared to unadjusted shown in dashed lines).

In this way, cylinder-to-cylinder variability may be reduced by learning and differentiating an air component of an AFR error from a fuel component of the AFR error. By adjusting subsequent engine fueling based on the air and fuel components, torque variations between cylinders can be compensated for using a single actuator. By inferring the air error from cylinder compression pressure, a cylinder air-charge may be estimated accurately while relying on existing sensors and without incurring noise effects from EGR. By commanding a DI open before a spark event with a high pressure pump disabled, no fuel is direct injected into the cylinder reducing corruption of results. By estimating the rise in DI fuel rail pressure during conditions when the cylinder is only fueled with port injection, more reliable and stable data points can be used to infer the air-charge. By learning and compensating for air errors, cylinder torque variations can be reduced, improving engine emissions and NVH.

One example method comprises: injecting fuel from a direct injector, with a high pressure pump disabled, to reduce a direct injection fuel rail pressure below a threshold pressure; and then, port injecting fuel into a cylinder and commanding the direct injector to selectively open a threshold duration before a spark event in the cylinder, without injecting any fuel from the direct injector. In the preceding example, additionally or optionally, the method further comprises learning a cylinder air-fuel ratio error based on a rise in the fuel rail pressure following the selectively opening. In any or all of the preceding examples, additionally or optionally, learning the cylinder air-fuel ratio error includes learning an air-charge estimate for the cylinder based on the rise in the fuel rail pressure. In any or all of the preceding examples, additionally or optionally, the method further comprises adjusting cylinder fueling responsive to the learned cylinder air-fuel ratio error, the cylinder fueling increased as the learned air-charge estimate exceeds an expected air-charge estimate, the cylinder fueling decreased as the learned air-charge estimate exceeds the expected air-charge estimate. In any or all of the preceding examples, additionally or optionally, the cylinder is one of a plurality of engine cylinders, the method further comprising, learning the air-charge estimate for each of the plurality of engine cylinders over a number of consecutive cylinder events. In any or all of the preceding examples, additionally or optionally, learning the cylinder air-fuel ratio error further includes learning the cylinder air-fuel ratio error based on a deviation between the air-charge estimate of the plurality of engine cylinders. In any or all of the preceding examples, additionally or optionally, the learning is performed in each of the plurality of cylinders over a number of combustion events in each cylinder, and wherein the air-charge estimate of a given cylinder is an average air-charge estimate, averaged over the number of combustion events in the given cylinder. In any or all of the preceding examples, additionally or optionally, the threshold pressure is a function of barometric pressure, and wherein the threshold duration is based on engine speed and load. In any or all of the preceding examples, additionally or optionally, the threshold pressure is a lower threshold pressure, the method further comprising, learning the cylinder air-fuel ratio error until the fuel rail pressure is above an upper threshold pressure, higher than the lower threshold pressure, then injecting fuel from the direct injector, with the high pressure pump disabled, to reduce the fuel rail pressure to the lower threshold pressure, and resuming the learning after the fuel rail pressure is below the lower threshold pressure. In any or all of the preceding examples, additionally or optionally, port injecting fuel into the cylinder includes port injecting during an exhaust stroke or an intake stroke of the cylinder, and wherein the direct injector is commanded to selectively open during a compression stroke of the cylinder. In any or all of the preceding examples, additionally or optionally, the method further comprises disabling the direct injector after reducing the direct injection fuel rail pressure below a threshold pressure, and wherein port injecting fuel into the cylinder includes not direct injecting fuel into the cylinder and maintaining the high pressure pump disabled.

Another example method for an engine comprises: with a high pressure fuel pump disabled, learning an air component of cylinder torque variation based on a first change in direct injection fuel rail pressure upon commanding a direct injector to selectively open a threshold duration before a spark event in a cylinder that is fueled via port injection only; and learning a fuel component of the cylinder torque variation based on a second change in direct injection fuel rail pressure upon commanding the direct injector to open in a cylinder that is fueled via direct injection only. In the preceding example, additionally or optionally, the first change in direct injection fuel rail pressure includes a rise in the fuel rail pressure and wherein the second change in direct injection fuel rail pressure includes a drop in the fuel rail pressure. In any or all of the preceding examples, additionally or optionally, during learning the air component, the direct injector is commanded to selectively open after the direct injection fuel rail pressure has been lowered to below a first threshold pressure, and wherein during learning the fuel component, the direct injector is commanded to open after the direct injection fuel rail pressure has been raised above a second threshold pressure. In any or all of the preceding examples, additionally or optionally, during both the learning the air component and the learning the fuel component, a high pressure fuel pump coupled to the direct injector is disabled. In any or all of the preceding examples, additionally or optionally, during learning the air component, the engine is fueled via port injection only and wherein during the learning the fuel component, the engine is fueled via direct injection only.

An example engine system comprises: an engine including a cylinder; a port injector coupled to the cylinder; a direct injector coupled to the cylinder; a high pressure fuel pump delivering fuel to the direct injector via a direct injection fuel rail; a pressure sensor for estimating a direct injection fuel rail pressure; and a controller with computer readable instructions stored on non-transitory memory for: operating the direct injector with the fuel pump disabled until the fuel rail pressure falls below a first threshold pressure, and then disabling the direct injector; transiently opening the direct injector during a compression stroke, but before a spark event, of the cylinder, without delivering any fuel; estimating cylinder air-charge based on a change in fuel rail pressure during the transient opening; and adjusting subsequent cylinder fueling based on the estimated cylinder air-charge. In the preceding example, additionally or optionally, the transiently opening is performed for a predefined number of injection events of the cylinder, wherein the estimated cylinder air-charge is an average cylinder air-charge averaged over the predefined number of injection events, and wherein adjusting subsequent cylinder fueling includes adjusting subsequent cylinder fueling via one or more of the port injector and the direct injector. In any or all of the preceding examples, additionally or optionally, the cylinder is one cylinder of a plurality of engine cylinders, wherein the fueling and transiently opening is performed for each of the plurality of engine cylinders over a number of consecutive injection events of the cylinder, and wherein adjusting subsequent cylinder fueling based on the estimated cylinder air-charge includes adjusting subsequent fueling for each engine cylinder based on the estimated cylinder air-charge of a corresponding cylinder relative to an average cylinder air-charge estimate, averaged over the plurality of engine cylinders. In any or all of the preceding examples, additionally or optionally, the transiently opening is performed while fueling the cylinder via the port injector only or during a deceleration fuel shut-off event.

In another representation, the engine system may be coupled in a hybrid electric vehicle.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

injecting fuel from a direct injector, with output of a high-pressure pump reduced, to lower direct injection fuel rail pressure below a threshold pressure;

then, port injecting fuel into a cylinder and commanding the direct injector to selectively open a threshold duration before a spark event in the cylinder, without injecting any fuel from the direct injector; and learning a cylinder air-charge estimate based on a rise in the fuel rail pressure.

2. The method of claim 1, wherein injecting fuel from the direct injector with the output of the high-pressure pump reduced includes injecting fuel from the direct injector with the high-pressure pump disabled.

3. The method of claim 1, further comprising, learning an air-fuel ratio error for the cylinder based on the learned air-charge estimate.

4. The method of claim 3, further comprising adjusting cylinder fueling responsive to the learned air-charge estimate for the cylinder, the cylinder fueling increased as the learned air-charge estimate exceeds an expected air-charge estimate, the cylinder fueling decreased as the learned air-charge estimate exceeds the expected air-charge estimate.

5. The method of claim 1, wherein the threshold pressure is determined as a function of one or more of barometric pressure, engine speed, and load.

6. The method of claim 1, wherein the threshold pressure is a pressure below which opening of the direct injector results in no fuel flowing out of the direct injector into the cylinder.

7. The method of claim 1, wherein the threshold pressure is lower than a compression pressure expected in the cylinder during a combustion event immediately following the spark event in the cylinder.

8. The method of claim 1, wherein the threshold duration is based on engine speed and load.

9. The method of claim 1, wherein port injecting fuel into the cylinder includes port injecting during an exhaust stroke or an intake stroke of the cylinder, and wherein the direct injector is commanded to open during a compression stroke of the cylinder.

10. The method of claim 1, wherein the rise in the fuel rail pressure is sensed via a direct injection fuel rail pressure sensor, and wherein commanding the direct injector to selectively open includes commanding a pulse-width to the direct injector based on a range and sensitivity of the fuel rail pressure sensor.

11. The method of claim 3, wherein the cylinder is one of a plurality of engine cylinders, the method further comprising learning the air-charge estimate for each of the plurality of engine cylinders over a number of consecutive cylinder events.

12. The method of claim 11, wherein learning the cylinder air-fuel ratio error further includes learning the cylinder air-fuel ratio error based on a deviation between the air-charge estimate of the plurality of engine cylinders.

13. The method of claim 11, wherein the threshold pressure is a lower threshold pressure, the method further comprising learning the air-charge estimate for each of the plurality of engine cylinders over the number of consecutive cylinder events until the fuel rail pressure is above an upper threshold pressure, higher than the lower threshold pressure, then injecting fuel from the direct injector with the output of the high-pressure pump reduced, to lower the fuel rail pressure to the lower threshold pressure, and then resuming the learning.

14. A method for an engine, comprising:

injecting fuel from a direct injector, with a high-pressure pump disabled, to lower direct injection fuel rail pressure below a threshold pressure;

then, injecting fuel into a cylinder from a port injector on an intake stroke of the cylinder and commanding the direct injector to selectively open on a compression stroke of the cylinder, before a spark event in the cylinder; and learning an air-fuel ratio error for the cylinder based on a sensed rise in the fuel rail pressure.

15. The method of claim 14, wherein the threshold pressure is a pressure below which the selectively opening of the direct injector results in no fuel flowing out of the direct injector into the cylinder.

16. The method of claim 15, wherein the cylinder is one of a plurality of engine cylinders, and the threshold pressure is a lower threshold pressure, the method further comprising:

learning the air-fuel ratio error for each of the plurality of engine cylinders over a number of consecutive cylinder events until the fuel rail pressure exceeds an upper threshold pressure, above which fuel flows into the cylinder when the direct injector is commanded open, the upper threshold pressure higher than the lower threshold pressure;

then, injecting fuel from the direct injector, with the high-pressure pump disabled, to lower the fuel rail pressure to the lower threshold pressure; and then, resuming the learning.

17. The method of claim 14, wherein learning the cylinder air-fuel ratio error includes learning an air-charge estimate for the cylinder based on the sensed rise in the fuel rail pressure.

18. The method of claim 14, wherein commanding the direct injector to selectively open on the compression stroke of the cylinder includes commanding the direct injector to open at a timing based on engine speed, the direct injector commanded open for a duration based on the engine speed.

19. The method of claim 14, further comprising, adjusting subsequent fueling of the cylinder based on the estimated cylinder air-charge.

20. The method of claim 14, wherein the injecting and learning is performed during a deceleration fuel shut-off event.

21. An engine system, comprising:

an engine including a cylinder;

each of a port fuel injector and a direct fuel injector coupled to the cylinder;

a high pressure fuel pump delivering fuel to the direct injector via a direct injection fuel rail;

a pressure sensor for estimating a direct injection fuel rail pressure; and a controller with computer readable instructions stored on non-transitory memory for:

operating the direct injector with the fuel pump disabled until the fuel rail pressure falls below a threshold pressure, and then disabling the direct injector, wherein below the first threshold pressure, operating the direct injector results in no fuel flowing out of the direct injector;

while port fueling the cylinder, transiently opening the direct injector before a spark event of the cylinder, without delivering any fuel via the direct injector, a timing and duration of opening the direct injector based on engine speed;

estimating cylinder air-charge based on a change in fuel rail pressure during the transient opening; and adjusting subsequent cylinder fueling based on the estimated cylinder air-charge.

22. The system of claim 21, wherein the threshold pressure is adjusted as a function of barometric pressure.

* * * * *